US009506322B2

(12) United States Patent
Prosser et al.

(10) Patent No.: US 9,506,322 B2
(45) Date of Patent: Nov. 29, 2016

(54) DOWNHOLE TOOL WITH EXPANDABLE ANNULAR PLUG SEAT ASSEMBLY HAVING CIRCUMFERENTIALLY OVERLAPPING SEAT SEGMENT JOINTS

(71) Applicant: UTEX Industries, Inc., Houston, TX (US)

(72) Inventors: Patrick Lawrence Prosser, Houston, TX (US); Derek L. Carter, Houston, TX (US); Mark Henry Naedler, Cypress, TX (US)

(73) Assignee: UTEX Industries, Inc., Houston, TX (US)

( * ) Notice: Subject to any disclaimer, the term of this patent is extended or adjusted under 35 U.S.C. 154(b) by 300 days.

(21) Appl. No.: 14/134,089

(22) Filed: Dec. 19, 2013

(65) Prior Publication Data

US 2015/0176361 A1 Jun. 25, 2015

(51) Int. Cl.
*E21B 34/14* (2006.01)

(52) U.S. Cl.
CPC ..... *E21B 34/14* (2013.01)

(58) Field of Classification Search
CPC ..... E21B 34/14
See application file for complete search history.

(56) References Cited

U.S. PATENT DOCUMENTS

| | | | | |
|---|---|---|---|---|
| 4,324,438 | A | 4/1982 | Lister | |
| 7,243,731 | B2 | 7/2007 | Watson et al. | |
| 2002/0043368 | A1 | 4/2002 | Bell et al. | |
| 2007/0131413 | A1 | 6/2007 | Millet et al. | |
| 2011/0048744 | A1 | 3/2011 | Conner et al. | |
| 2012/0227973 | A1 | 9/2012 | Hart et al. | |
| 2012/0305236 | A1 | 12/2012 | Gouthaman | |
| 2013/0118732 | A1* | 5/2013 | Chauffe | E21B 34/06 166/250.04 |
| 2013/0299199 | A1 | 11/2013 | Naedler et al. | |

OTHER PUBLICATIONS

International Search Report and Written Opinion issued for PCT/US2014/055483 dated Dec. 16, 2014, 10 pgs.

* cited by examiner

*Primary Examiner* — Brad Harcourt
(74) *Attorney, Agent, or Firm* — Haynes & Boone, LLP

(57) ABSTRACT

A tubular downhole tool, representatively a sliding sleeve valve, coaxially supports within its interior an annular plug ball seat formed from a series of rigid, arcuate segments that circumferentially overlap one another in various representatively disclosed manners. The seat is expandable from a diametrically compressed orientation, toward which it is resiliently biased, to a diametrically expanded orientation by a plug ball pumped through the seat. Due to the circumferential segment-to-segment overlap, each segment is blocked by its two circumferentially adjacent segments from being axially separated from the overall seat assembly by operational pressure forces.

24 Claims, 6 Drawing Sheets

DOWNHOLE TOOL WITH EXPANDABLE ANNULAR PLUG SEAT ASSEMBLY HAVING CIRCUMFERENTIALLY OVERLAPPING SEAT SEGMENT JOINTS

BACKGROUND OF THE INVENTION

The present invention relates generally to the control of tools used downhole in a subterranean wellbore and more particularly provides, in various illustratively depicted embodiments thereof, specially designed annular plug seat assemblies having circumferentially overlapping seat segment joints.

A common practice for controlling various types of tools downhole, such as for example, sliding sleeve valves, is to use pressurized fluid to flow a ball (or other type of plug structure) down the wellbore to land on a generally annular seat structure operatively associated with the particular tool. When the ball lands on the seat, it blocks fluid from flowing in a downhole direction through the seat, thereby creating a pressure drop across the seat that may be utilized to create a control event such as shifting a sliding sleeve valve.

Many seat configurations have been previously proposed, the most simplistic of which being a solid ring with an inner diameter smaller than the ball's diameter. Seats capable of expanding to let the ball pass therethrough have also been previously proposed. These seats incorporated a collet-like structure, or radial dogs contained in an axially movable sleeve, and when engaged by a ball were slidable to a further downhole position at which diametrical expansion of the collet or dogs was permitted to allow the ball to pass through the seat. Such previously proposed seat designs often proved to be problematic since they have inherent gaps that could be infiltrated by sand, mud, cement or grit often present in the well. These gaps between the circumferential seat segments could be present when balls were not passing through the seats, thus enabling the infiltrating contaminants to cause system seize-up.

Another previously proposed diametrically expandable annular seat design, illustrated and described in copending U.S. patent application Ser. No. 13/887,779 filed May 6, 2013 and assigned to the assignee of the present invention, does not incorporate a collet-like structure, or have radially sliding dogs contained within an axially moveable sleeve. Instead, a circumferentially segmented annular seat rests against a conical shoulder rigidly affixed to the tool. The seat is diametrically compressed from the opposing side with a conically engaging sleeve that is biased against the seat via a spring or by fluid pressure. In this seat design there are no gaps for contamination to penetrate during periods when balls are not passing through the seat. This is especially important when hydraulically fracturing a well since cement and proppant would certainly penetrate such gaps. Conveniently, when hydraulically fracturing a well with a sliding sleeve ball drop system, the practice is typically to remove the slurry while pumping down a ball to create a pad of clean water around the ball. Consequently, momentary gaps while the ball passes do not see proppant, mud, or cement. This practice is primarily used to reduce the chance of an undesirable screen-out condition.

While this last-mentioned annular plug seat design has been found to be generally satisfactory for its intended purposes, and superior in performance to seats with collet or dog configurations, it has also been found that a single plane axially extending interface provided between each circumferentially adjacent seat segment pair may, in some instances such as when the balls are pumped downhole at higher speeds, cause the seat to malfunction. It is desirable to pump balls at a fast rate since pumping down too slowly can cause the proppant to fall out of suspension with the associated fluid. When balls are pumped down at too great a speed, the simple single plane interfaces between each circumferentially adjacent seat segment pair may allow individual seat segments to be washed into the bore in front of the ball. Such seat segment washout (in which a segment is axially separated from the balance of the seat) typically causes complete collapse of the seat and/or seizure of the non-washed out segments in a manner preventing balls from passing through the remainder of the seat.

As can be seen from the foregoing, a need exists for an improved annular downhole tool plug seat structure that eliminates or at least substantially alleviates the above-mentioned problems, limitations and disadvantages of previously proposed seat designs as generally described above. It is to this need that the present invention is primarily directed.

DETAILED DESCRIPTION

Figure 1:
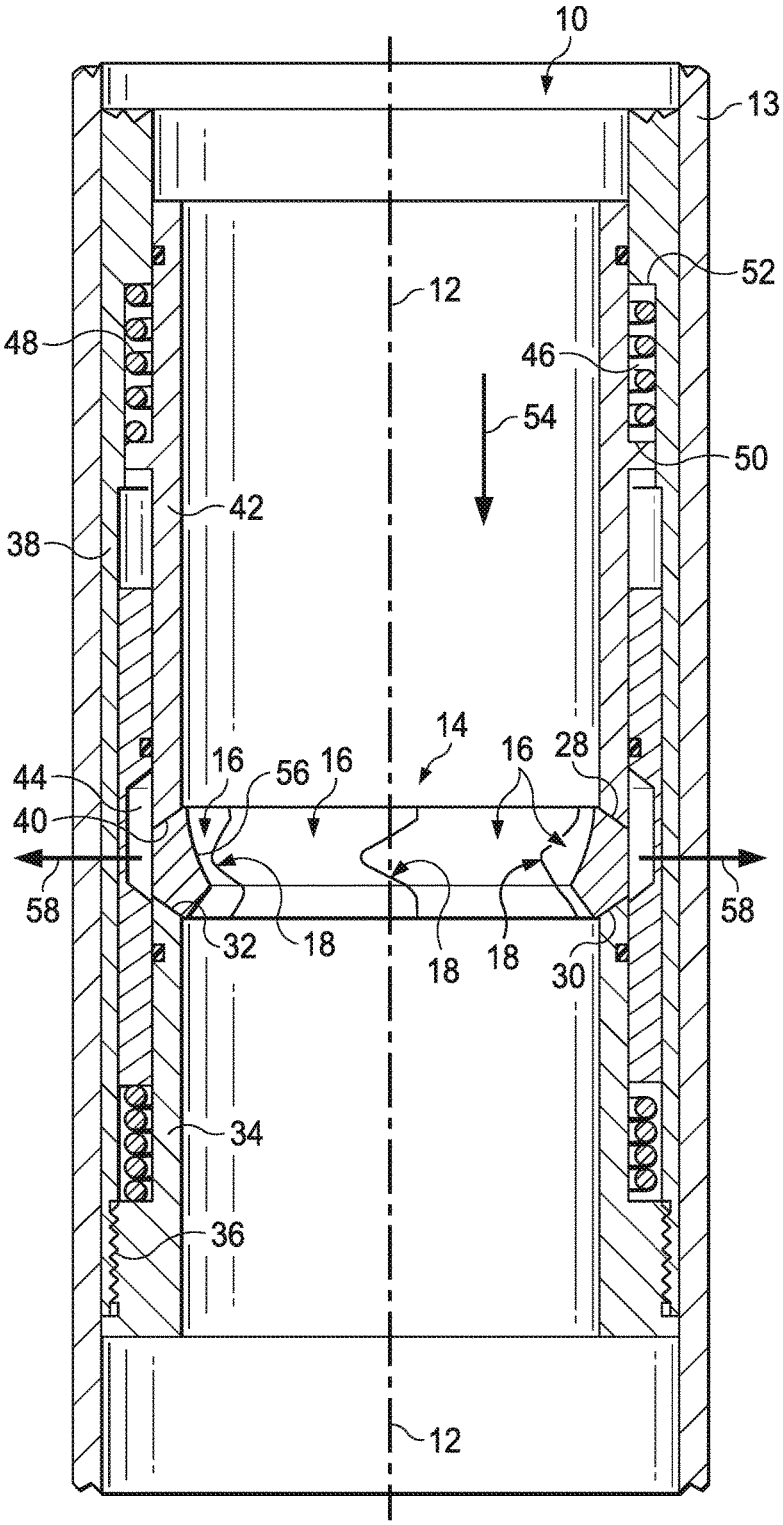
FIG. 1 is a cross-sectional view through a representative downhole tool operatively incorporating therein a specially designed circumferentially segmented plug seat assembly embodying principles of the present invention.
Figure 2:
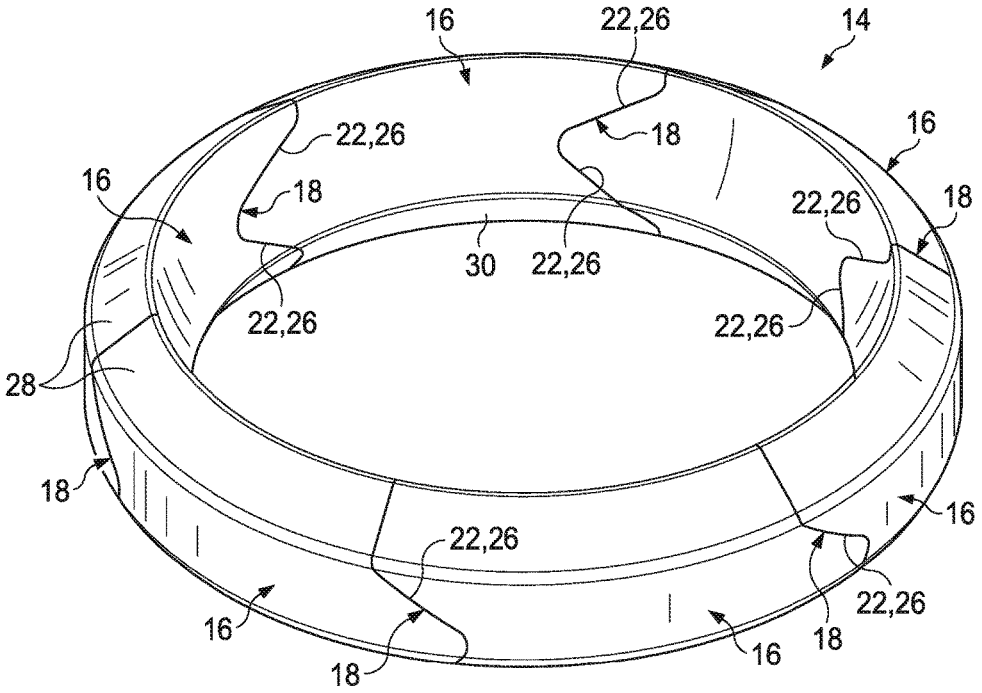
FIG. 2 is an enlarged scale perspective view of the plug seat assembly in a diametrically compressed orientation.
Figure 3:
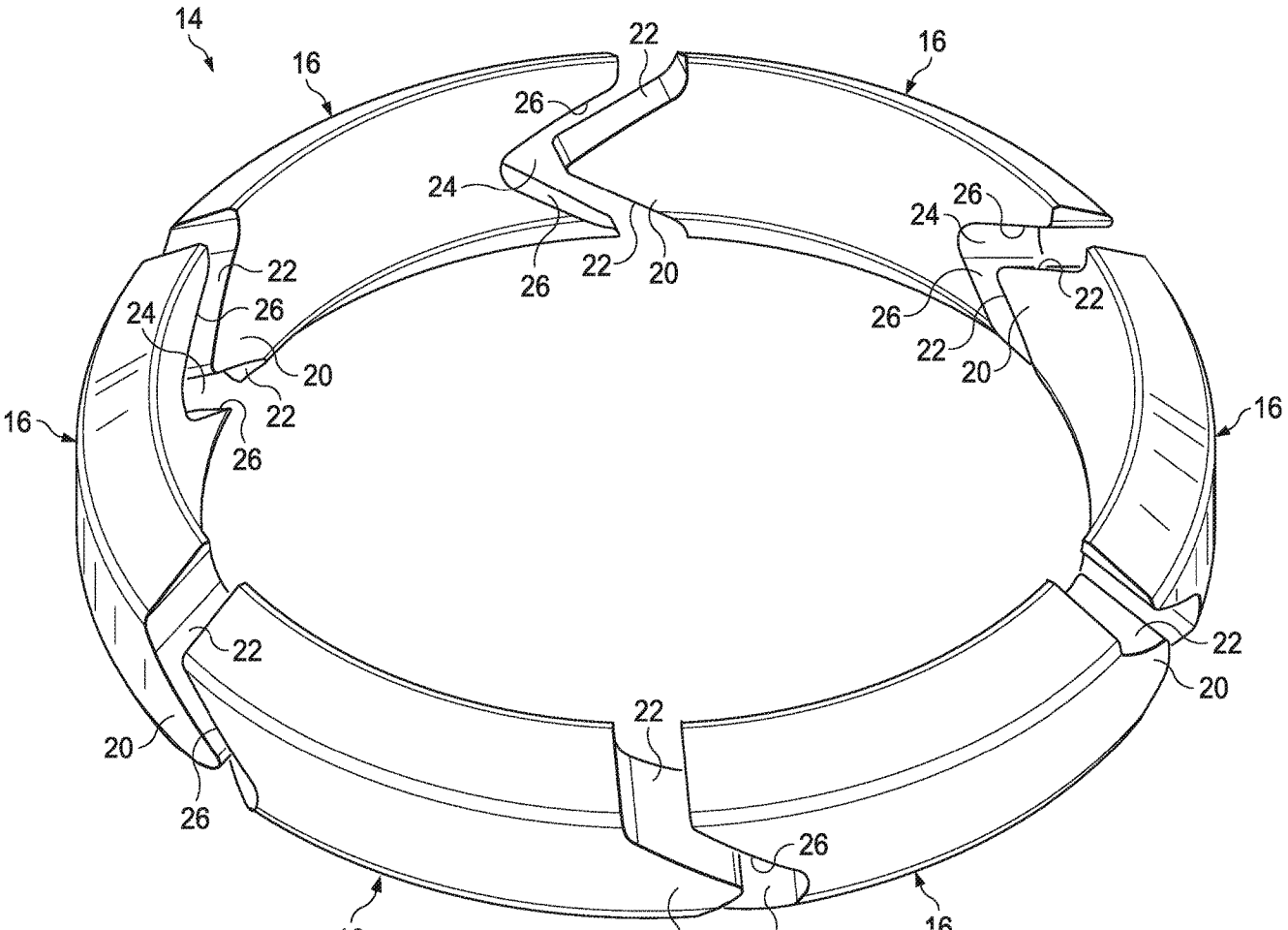
FIG. 3 is an enlarged scale perspective view of the plug seat assembly in a diametrically expanded orientation.

Cross-sectionally illustrated in FIG. 1 is a representative tubular downhole tool 10 centered about a longitudinal axis 12 and coaxially received in a tubing section 13 of a wellbore string. Tool 10 which, by way of non-limiting example, is a sliding sleeve valve, operatively and coaxially supports therein a first embodiment 14 of a specially designed annular, diametrically expandable plug seat assembly embodying principles of the present invention. Referring now additionally to FIGS. 2 and 3, plug seat assembly 14 includes a series of arcuate rigid peripheral circumferential segments 16 (representatively, but not by way of limitation, six in number) illustratively formed from a suitable metal material. At facing ends thereof each circumferentially adjacent pair of segments 16 circumferentially overlap each other at multifaceted juncture areas 18 (see FIGS. 1 and 2)

which serve to prevent, by means of a rigid blocking action between each given segment 16 and the two segments 16 between which it is interposed, the axial separation in either direction of the given segment 16 from the balance of the plug seat 14.

In the plug seat embodiment 14 shown in FIGS. 1-3, the segment ends that form each of the multifaceted juncture areas 18 have zig-zagged or "puzzle cut" configurations such that the two ends slidably interlock as may be best seen by comparing FIGS. 2 and 3. Plug seat 14, as later described herein, when operatively supported in the tool 10, is expandable from a FIG. 2 diametrically compressed orientation initially blocking a pre-selected plug ball (not shown) from passing therethrough, to a FIG. 3 diametrically expanded orientation in which the interior diameter of the plug seat 14 is increased (by fluid pressure on a plug ball landing on the seat) to an extent permitting the plug ball to pass through the plug seat 14. In each of these two diametric orientations of the plug seat 14, the segments 16 circumferentially overlap one another in a manner preventing any of the segments 16 from being completely dislodged axially from the rest of the seat segments 16.

As can best be seen in FIG. 3, each of the rigid segments 16 has one end on which a generally V-shaped projection 20 is formed and has angled facet portions 22, and an opposite end on which a generally V-shaped recess 24 is formed and has angled facet portions 26. Each projection 20 is complementarily receivable in one of the recesses 24 in a manner such that with the plug seat 14 in its FIG. 2 diametrically compressed orientation, the facet pairs 22 of each segment 16 are slidingly and sealingly engaged with the facet pairs 26 of an adjacent segment 16. As illustrated in FIGS. 1 and 2, the plug seat 14, when in its diametrically compressed orientation has conically tapered, oppositely sloped annular peripheral surfaces 28,30 respectively disposed on its top and bottom sides.

As cross-sectionally depicted in FIG. 1, the expandable plug seat 14 is coaxially sandwiched between (1) the conically tapered end surface 32 of a rigid tubular member 34 coaxially anchored, as by a threaded connection 36, to a tubular sleeve 38 slidably received in the wellbore string tubular section 13, and (2) the conically tapered end surface 40 of an axially shiftable tubing component 42 telescoped within the tubular sleeve 38. The tapered top annular peripheral surface 28 of the expandable seat 14 is slidably and complementarily engaged by the conically tapered end surface 40, and the tapered bottom annular peripheral surface 30 of the expandable seat 14 is slidably and complementarily engaged by the conically tapered end surface 32. For purposes later described herein, an annular pocket area 44 is formed within the interior of the tool 10 and outwardly circumscribes the expandable seat 14.

Between the tubular members 38 and 42 another annular pocket area 46 is formed within the tool 10 and receives an annular compression spring structure 48 that forcibly bears against axially opposing annular portions 50,52 of the tubular members 42,38 and resiliently biases the tubular member 42 in a downhole direction 54. This causes the tapered peripheral surface areas 28,30 of the expandable seat 14 to be forcibly wedged between the tapered tubular member end surfaces 40,32 to thereby cammingly create around the periphery of the seat 14 a radially inwardly directed force that yieldingly urges the seat 14 toward its diametrically compressed orientation shown in FIGS. 1 and 2.

When a plug ball (not shown), or another type of plug member, is downwardly pumped through the interior of the tool 10 and complementarily engages the concavely curved inner side surface 56 of the expandable seat 14, a fluid pressure drop is created axially across the seat 14. This pressure drop, in turn, generates a radially outwardly directed force 58 around the periphery of the seat 14 that cammingly drives the tubing component 42 upwardly away from its FIG. 1 position, against the biasing force of the spring 48, and diametrically expands the seat 14 into the pocket area 44 to the FIG. 3 diametrically expanded orientation of the seat 14, thereby permitting the ball to be pumped downwardly through the expanded seat 14

Upon passage of the ball through the expanded seat 14, the spring 48 downwardly returns the upwardly displaced tubing component 42 to its FIG. 1 position to thereby cammingly drive the diametrically expanded seat 14 back to its diametrically compressed orientation shown in FIGS. 1 and 2. As described above, the circumferentially overlapping of the individual seat segments 16 prevents axial separation of any of the segments 16 from the balance of the overall seat assembly 14. When the seat 14 is returned to its diametrically compressed orientation, the multifaceted segment ends re-seal at their juncture areas 18.

Figure 4:
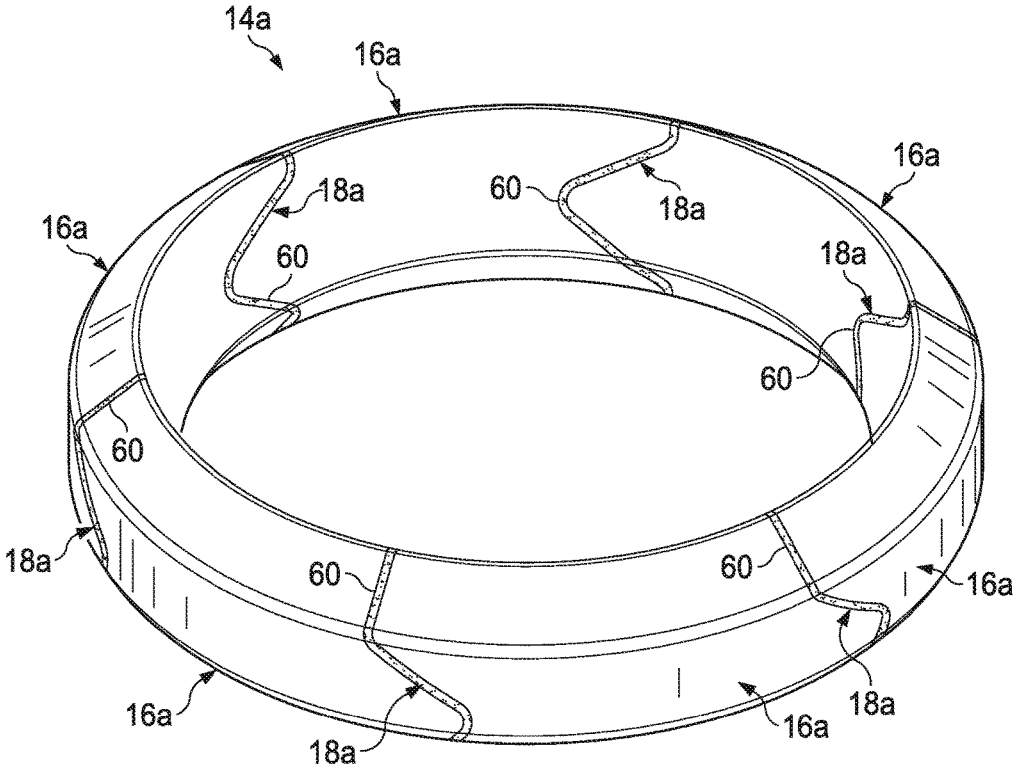
FIG. 4 is an enlarged scale perspective view of a first alternative embodiment of the plug seat assembly in a diametrically compressed orientation.

A first alternate embodiment 14*a* of the previously described expandable plug seat 14 is perspectively illustrated in its diametrically compressed orientation in FIG. 4. To facilitate the comparison of the plug seats 14 and 14*a*, components in the seat 14*a* similar to those in the seat 14 have been given identical reference numerals to which the subscript "a" have been appended. Expandable plug seat 14*a* is identical to seat 14 with the exception that in the seat 14*a* layers of a suitable elastomeric material 60 are bonded within the multifaceted juncture areas 18*a* of the seat 14*a*. Each elastomeric material layer 60 may be bonded to both of its two associated facing seat segment ends, or to only one of them. The use of the elastomeric material 60 desirably eliminates the necessity to precisely machine the segment end facets to achieve a fluid tight seal at the segment juncture areas when the seat assembly 14*a* is in its diametrically compressed orientation.

Figure 5:
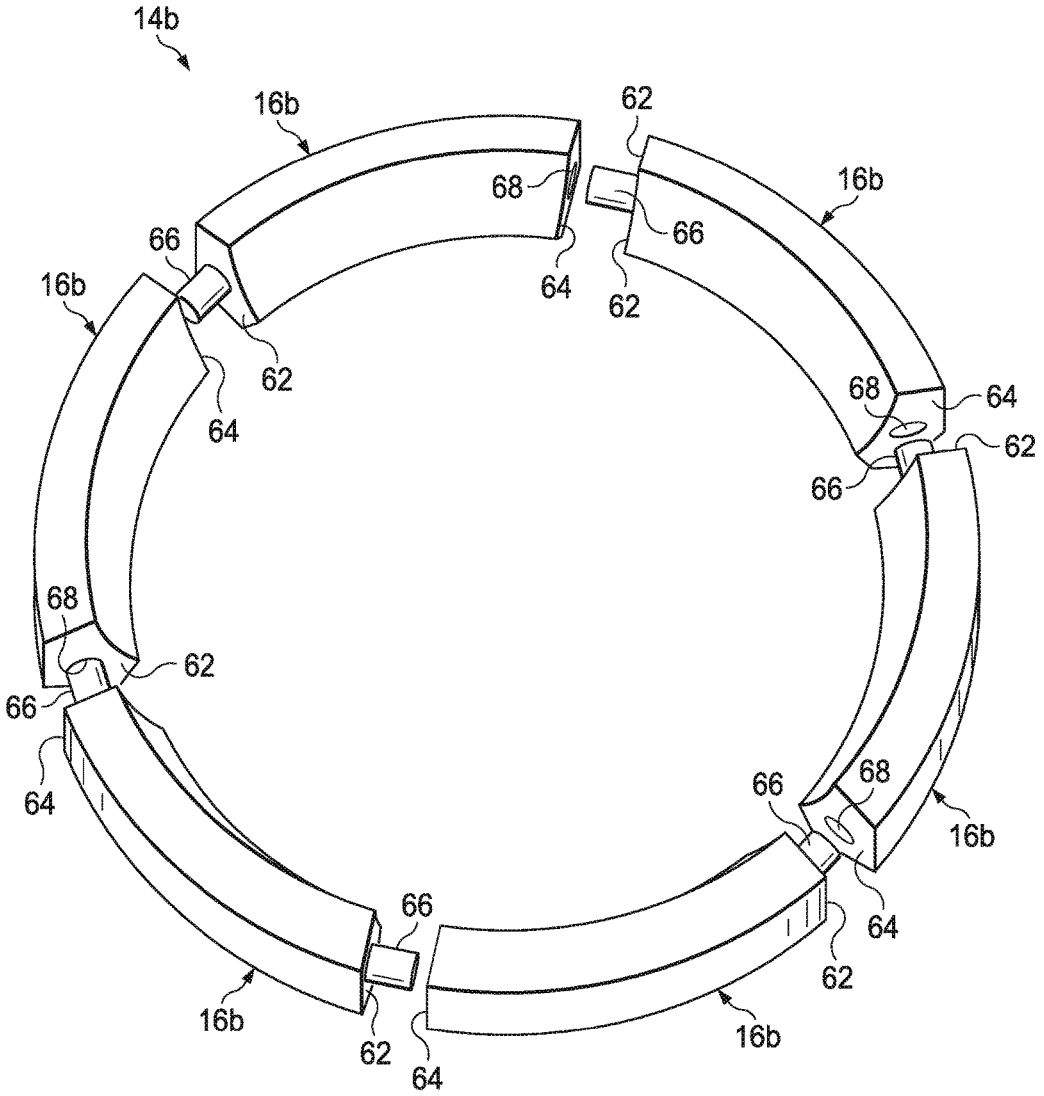
FIG. 5 is an enlarged scale perspective view of a second alternative embodiment of the plug seat assembly in a diametrically expanded orientation.

A second alternate embodiment 14*b* of the previously described expandable plug seat 14 is perspectively illustrated in FIG. 5 in a diametrically expanded orientation which, for illustrative purposes, is of a larger diameter than would be momentarily created by a plug ball operatively passing therethrough in the tool 10. To facilitate the comparison of the plug seats 14 and 14*b*, components in the seat 14 similar to those in the seat 14 have been given identical reference numerals to which the subscript "a" have been appended. Unlike the segments 16 of seat 14, the seat segments 16*b* of the expandable plug seat 14*b* do not have zig-zagged multi-faceted "puzzle cut" opposite ends to create circumferential overlapping between adjacent segment ends. Instead, the opposite ends 62,64 of the main body of each seat segment 16*b* lie in single, axially extending planes, with circularly cross-sectioned pin portions 66 projecting outwardly from the ends 62 and being complementarily and slidably receivable in corresponding circularly cross-sectioned holes 68 extending inwardly into the ends 64. This permits the seat 14*b* to expand and contract between its diametrically compressed and expanded positions with the pin/hole surface interfaces all the while maintaining a circumferential segment overlap that prevents axial separation of any one of the segments 16*b* from the balance of the overall expandable seat 14*b*.

As can be seen in FIG. 5, while the segment pin portions 66 prevent axial separation of any seat segment 16*b* from the balance of the seat 14*b*, under certain operational conditions the seat segments may exhibit a tendency to slightly "rock"

around the pin axes. If such an event is anticipated and considered undesirable, such segment rocking may be easily eliminated, as shown in a portion of an alternate embodiment 14*c* of the expandable seat 14*b* schematically depicted in FIG. 6. To facilitate the comparison of the plug seats 14*c* and 14*b*, components in the seat 14*c* similar to those in the seat 14*b* have been given identical reference numerals to which the subscript "c" have been appended.

Figure 6:
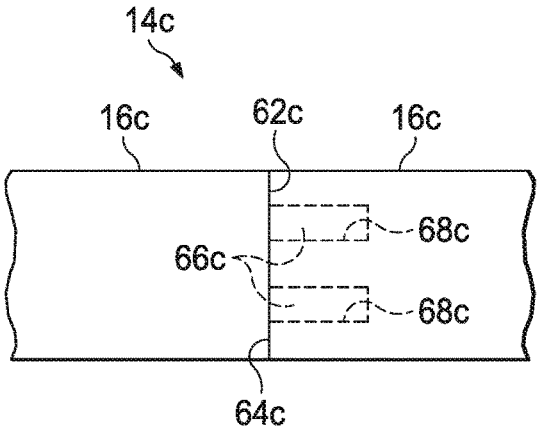
FIG. 6 is a schematic, radially inwardly directed, partially phantomed elevational view of portions of a circumferentially adjacent segment pair of a third alternative embodiment of the plug seat assembly in a diametrically compressed orientation.

Schematically shown in FIG. 6 are portions of two adjacent seat segments 16*c* in an abutting relationship that they assume with the seat 14*c* in its diametrically compressed orientation. Instead of utilizing a single pin on one end of each seat segment, in the seat 14*c* each planar segment end 62*c* has two pins 66*c* projecting therefrom and slidably received in two holes 68*c* projecting into the end 64*c* of an adjacent segment 62*c*, thereby preventing rocking of any of the segments 16*c* relative to the balance of the seat 14*c*.

Figure 7:
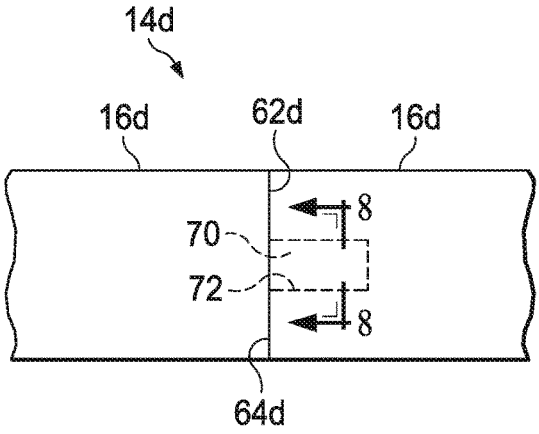
FIG. 7 is a schematic, radially inwardly directed, partially phantomed elevational view of portions of a circumferentially adjacent segment pair of a fourth alternative embodiment of the plug seat assembly in a diametrically compressed orientation.
Figure 8:
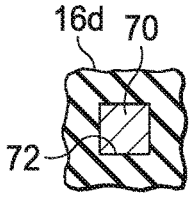
FIG. 8 is a cross-sectional view through one of the FIG. 7 plug seat assembly segments taken along line 8-8 of FIG. 7.

A schematically depicted portion of an alternate embodiment 14*d* of the two segment pin seat embodiment 14*c* is shown in FIG. 7. To facilitate the comparison of the plug seats 14*d* and 14*c*, components in the seat 14*d* similar to those in the seat 14*c* have been given identical reference numerals to which the subscript "d" have been appended. In the seat embodiment 14*d*, the seat 14*c* circular holes 66*c* and holes 68*c* are replaced with a single, non-circularly cross-sectioned segment end pin 70 (representatively of a rectangular cross-section as shown in FIG. 8) which is slidably received in a complementarily configured segment end hole 72 to prevent undesired seat segment rocking.

The foregoing detailed description is to be clearly understood as being given by way of illustration and example only, the spirit and scope of the present invention being limited solely by the appended claims.

What is claimed is:

1. A downhole tool comprising:

a tubular structure; and an annular plug seat coaxially supported within the interior of said tubular structure and being expandable from a diametrically compressed orientation to a diametrically expanded orientation, said annular plug seat including a series of arcuate rigid peripheral circumferential segments that circumferentially overlap one another in a manner blockingly preventing axial separation of any segment from the rest of said segments, wherein facing ends of each circumferentially adjacent pair of said segments circumferentially overlap each other at multifaceted, puzzle-cut juncture areas that serve to prevent, by means of a blocking action between each given segment and the two segments between which it is interposed, axial separation of the given segment from the balance of said plug seat.

2. The downhole tool of claim 1 wherein:

said downhole tool is a sliding sleeve valve.

3. The downhole tool of claim 1 wherein:

said annular plug seat is resiliently expandable from said diametrically compressed orientation to said diametrically expanded orientation.

4. The downhole tool of claim 3 wherein:

a portion of said tubular structure resiliently biases said annular plug seat toward said diametrically compressed orientation thereof.

5. The downhole tool of claim 4 wherein:

said annular plug seat has axially oppositely sloped annular conical surfaces disposed on opposite side edges thereof, and said portion of said tubular structure includes opposing tubular members having conically tapered end surfaces complementarily engaging said conical surfaces of said annular plug seat, and a spring structure resiliently biasing one of said tubular members axially toward the other tubular member.

6. The downhole tool of claim 1 wherein:

each segment has, on one end thereof, a generally V-shaped projection, and a generally V-shaped recess disposed on the other end thereof and complementarily receiving the generally V-shaped projection of another one of said segments.

7. The downhole tool of claim 1 wherein:

each of said juncture areas has disposed therein a layer of an elastomeric material bonded to at least one of the two segments between which the juncture area is formed.

8. The downhole tool of claim 1 wherein:

each segment has, on one end thereof, an outwardly projecting pin, and an inwardly extending opening disposed on the other end thereof and complementarily and slidingly receiving the outwardly projecting pin of another one of said segments.

9. The downhole tool of claim 8 wherein:

each outwardly projecting pin and inwardly extending opening has a circular cross-section.

10. The downhole tool of claim 8 wherein:

each outwardly projecting pin and inwardly extending opening has a non-circular cross-section.

11. The downhole tool of claim 1 wherein:

each segment has, on one end thereof, a plurality of outwardly projecting pins, and a plurality of inwardly extending openings disposed on the other end thereof and complementarily and slidingly receiving the outwardly projecting pins of another one of said segments.

12. An annular plug seat coaxially supportable within a tubular portion of a downhole tool and being expandable therein through a dimensional operational range from a diametrically compressed orientation to a diametrically expanded orientation by a plug ball pumped axially therethrough, said annular plug seat comprising a series of arcuate rigid peripheral circumferential segment that circumferentially overlap one another in a manner blockingly preventing axial separation of any segment from the rest of said segments when said annular plug seat is within said dimensional operational range thereof, wherein facing ends of each circumferentially adjacent pair of said segments circumferentially overlap each other at multifaceted, puzzle-cut juncture areas that serve to prevent, by means of a blocking action between each given segment and the two segments between which it is interposed, axial separation of the given segment from the balance of said annular plug seat when said annular plug seat is within said operational range thereof.

13. The annular plug seat of claim 12 wherein:

said annular plug seat, when in said diametrically compresses orientation thereof, has axially oppositely sloped annular conical surfaces disposed on opposite side edges thereof.

14. The annular plug seat of claim 12 wherein:

each segment has, on one end thereof, a generally V-shaped projection, and a generally V-shaped recess disposed on the other end thereof and complementarily receiving the generally V-shaped projection of another one of said segments.

15. The annular plug seat of claim 12 wherein:

each of said juncture areas has disposed therein a layer of an elastomeric material bonded to at least one of the two segments between which the juncture area is formed.

16. The annular plug seat of claim 12 wherein:

each segment has, on one end thereof, an outwardly projecting pin, and an inwardly extending opening disposed on the other end thereof and complementarily and slidingly receiving the outwardly projecting pin of another one of said segments.

17. The annular plug seat of claim 16 wherein:

each outwardly projecting pin and inwardly extending opening has a circular cross-section.

18. The annular plug seat of claim 16 wherein:

each outwardly projecting pin and inwardly extending opening has a non-circular cross-section.

19. The annular plug seat of claim 12 wherein:

each segment has, on one end thereof, a plurality of outwardly projecting pins, and a plurality of inwardly extending openings disposed on the other end thereof and complementarily and slidingly receiving the outwardly projecting pins of another one of said segments.

20. A downhole tool comprising:

a tubular structure; and an annular plug seat coaxially supported within the interior of said tubular structure and being expandable from a diametrically compressed orientation to a diametrically expanded orientation, said annular plug seat including a series of arcuate rigid peripheral circumferential segments that circumferentially overlap one another in a manner blockingly preventing axial separation of any segment from the rest of said segments, wherein facing ends of each circumferentially adjacent pair of said segments circumferentially overlap each other at multifaceted juncture areas such that the facing ends slidably interlock and serve to limit, by means of a rigid blocking action between each given segment and the two segments between which it is interposed, movement in an axial direction of the given segment.

21. The downhole tool of claim 20, wherein:

each segment has, on one end thereof, a generally V-shaped projection, and a generally V-shaped recess disposed on the other end thereof and complementarily receiving the generally V-shaped projection of another one of said segments.

22. The downhole tool of claim 20, wherein:

each of said juncture areas has disposed therein a layer of an elastomeric material bonded to at least one of the two segments between which the juncture area is formed.

23. The downhole tool of claim 20, wherein:

said annular plug seat is resiliently expandable from said diametrically compressed orientation to said diametrically expanded orientation.

24. The downhole tool of claim 20, wherein:

the slidably interlocking facing ends overlap each other at puzzle-cut juncture areas.

* * * * *